US010948158B1

(12) United States Patent
English

(10) Patent No.: US 10,948,158 B1
(45) Date of Patent: Mar. 16, 2021

(54) ILLUMINATED LIGHT STAND

(71) Applicant: Dan English, Brooklyn, NY (US)

(72) Inventor: Dan English, Brooklyn, NY (US)

( * ) Notice: Subject to any disclaimer, the term of this patent is extended or adjusted under 35 U.S.C. 154(b) by 0 days.

(21) Appl. No.: 17/073,691

(22) Filed: Oct. 19, 2020

(51) Int. Cl.

| | |
|---|---|
| ***F21V 3/06*** | (2018.01) |
| ***F21V 23/00*** | (2015.01) |
| ***F21V 21/06*** | (2006.01) |
| ***F21W 131/40*** | (2006.01) |
| ***F21Y 115/10*** | (2016.01) |

(52) U.S. Cl.
CPC ..... *F21V 3/0615* (2018.02); *F21V 21/06* (2013.01); *F21V 23/001* (2013.01); *F21V 23/003* (2013.01); *F21W 2131/40* (2013.01); *F21Y 2115/10* (2016.08)

(58) Field of Classification Search
CPC ..... F21V 3/0615; F21V 21/06; F21V 23/001; F21V 23/003
USPC ..... 362/241
See application file for complete search history.

(56) References Cited

U.S. PATENT DOCUMENTS

| | | | | |
|---|---|---|---|---|
| 3,961,176 A * | 6/1976 | Gleason | F21V 21/06 362/413 |
| 4,562,520 A * | 12/1985 | Chapman | F21S 6/006 248/289.11 |
| 4,827,389 A * | 5/1989 | Crum | F21S 8/081 362/388 |
| 5,236,160 A * | 8/1993 | Sechelski | F21L 14/00 248/125.1 |
| 5,598,652 A * | 2/1997 | Nurre | G09F 13/00 362/412 |
| 6,135,622 A * | 10/2000 | Downing | F21S 6/005 362/410 |
| 2018/0073709 A1* | 3/2018 | Enck, Sr. | F21V 21/06 |
| 2018/0241950 A1* | 8/2018 | Chang | H04N 5/2627 |

* cited by examiner

*Primary Examiner* — Bryon T Gyllstrom
(74) *Attorney, Agent, or Firm* — Stuart M. Goldstein

(57) ABSTRACT

An illuminated lighting stand has a lighting fixture head mount, a bottom base, and an elongated, upright illumination pole extending between the head mount and the bottom base. The illumination pole consists of an elongated, upright skeletal support pipe, RGB tape surrounding the support pipe, diffusing material circumscribing the RGB tape, and a transparent outer tube covering the diffusing material, all these elements extending the length of the illumination pole. An electrical power supply and Wi-Fi electronics are housed within the base to illuminate and control the illumination sequencing and functioning of the light stand.

6 Claims, 6 Drawing Sheets

ILLUMINATED LIGHT STAND

BACKGROUND OF THE INVENTION

Entertainment, theatrical, and exhibition, as well as practical illumination systems, have long been employed to enhance and highlight presentations, shows, performances, and the like. Such systems are commonly elevated, usually mounted on pipes and bases or on lighting supports or trusses with bases. For artistic effects, trusses are sometimes lighted as well. However, such systems are usually quite complex, in that they involve many lighting components, support members, extensive wiring, and power sources. There is currently no one product which will reduce the number of lighting system components, thereby also eliminating extensive time consuming set-up and take-down.

SUMMARY OF THE INVENTION

It is thus the object of the present invention to overcome the disadvantages and limitations presented by decorative, entertainment oriented lighting systems.

It is the object of the present invention to provide an illuminated light stand which employs RGB LED technology to provide the stand itself with unlimited color combinations and displays.

It is another object of the present invention to provide an illuminated light stand which also still provides a utilitarian function in its ability to support any variety of lighting fixtures.

It is still another object of the present invention to provide an illuminated light stand which is portable and easy and simple to set-up and take-down.

It is a further object of the present invention to provide an illuminated light stand which consists of an all-in-one unit, having both fixture lighting support, decorative lighting, and Wi-Fi signal receiving and transmitting capabilities.

These and other objects are accomplished by the present invention, an illuminated lighting stand having a lighting fixture head mount, a bottom base, and an elongated, upright illumination pole extending between the head mount and the bottom base. The illumination pole consists of an elongated, upright skeletal support pipe, RGB tape surrounding the support pipe, diffusing material circumscribing the RGB tape, and a transparent outer tube covering the diffusing material, all these elements extending the length of the illumination pole. An electrical power supply and Wi-Fi electronics are housed within the base to illuminate and control the illumination sequencing and functioning of the light stand.

The novel features which are considered as characteristic of the invention are set forth in particular in the appended claims. The invention itself, however, both as to its design, construction, and use, together with additional features and advantages thereof, are best understood upon review of the following detailed description with reference to the accompanying drawings.

BRIEF DESCRIPTION OF THE DRAWINGS

Fla 1 is a view of the illuminated light stand of the present invention with a lighting fixture mounted thereon.

DETAILED DESCRIPTION OF THE INVENTION

Figure 1:
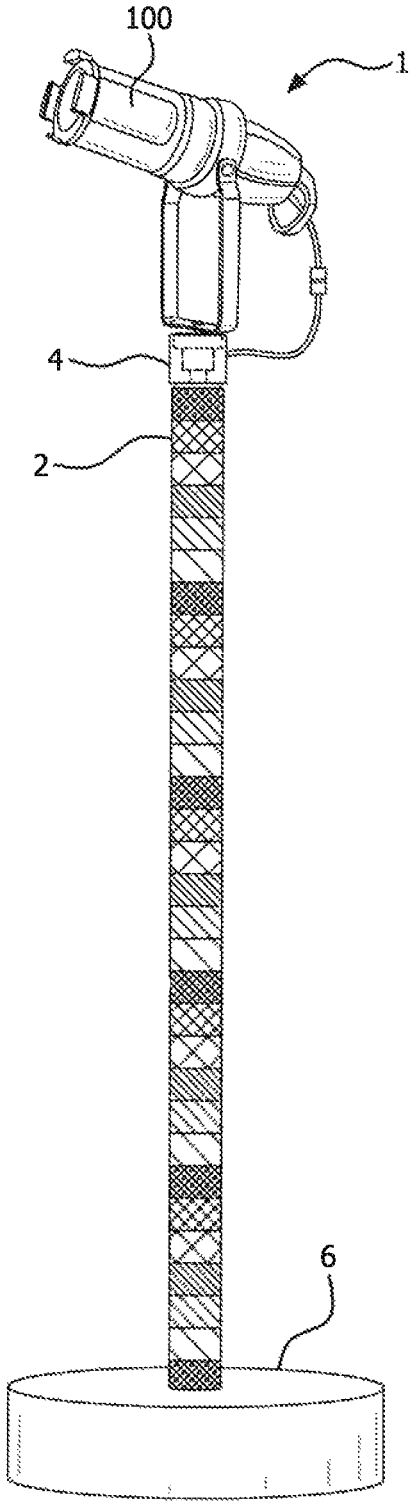
Figure 2:
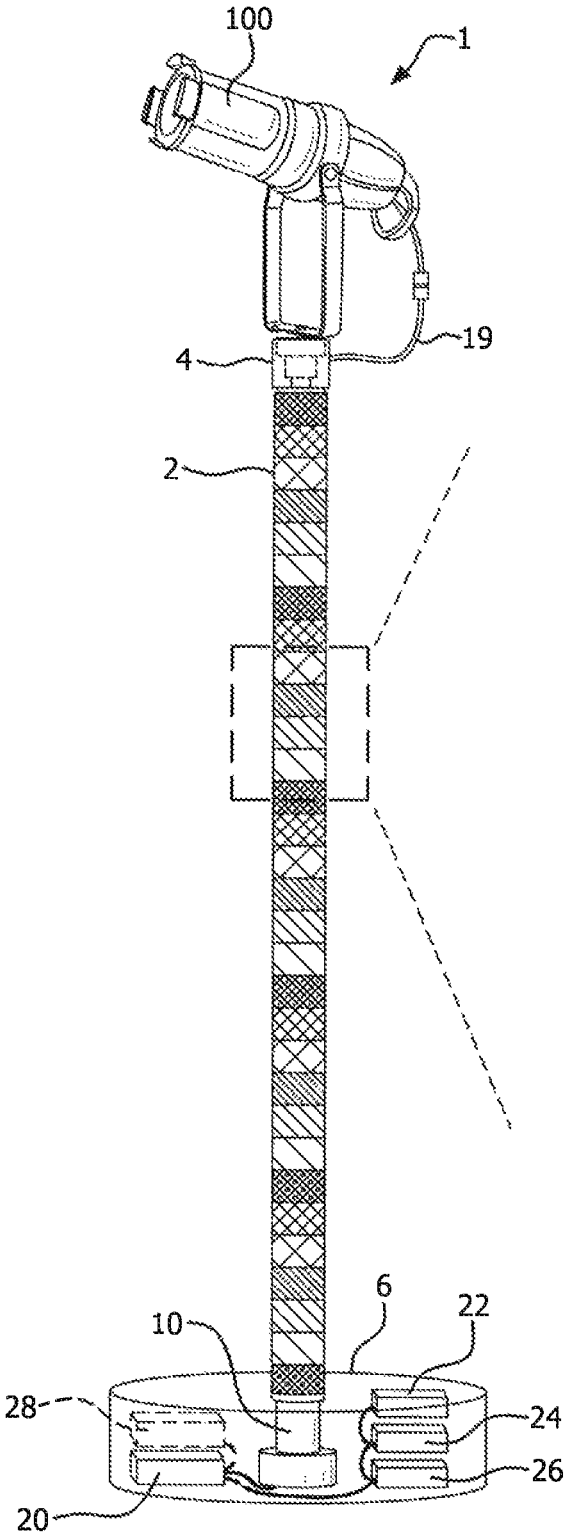
FIG. 2 is a view of the illuminated light stand of the present invention showing the locations of its power supply and electronic components.

Light stand 1 of the present invention comprises elongated, upright illumination pole 2 which extends between light fixture supporting head mount 4 and light stand base 6.

Illumination pole 2 consists of elongated, upright skeletal support pipe 8, the length of which extends between head mount 4 and base 6. Pipe 8 extends the length of pole 2 and has upper cable access hole 9 and lower cable access hole 11.

Figure 3:
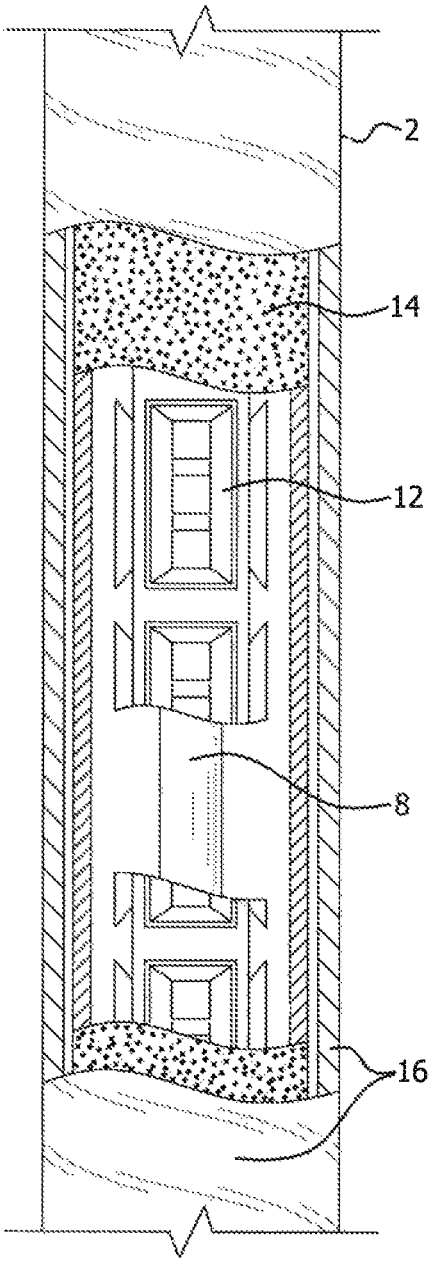
FIG. 3 is a partial sectional view taken from FIG. 2.
Figure 4:
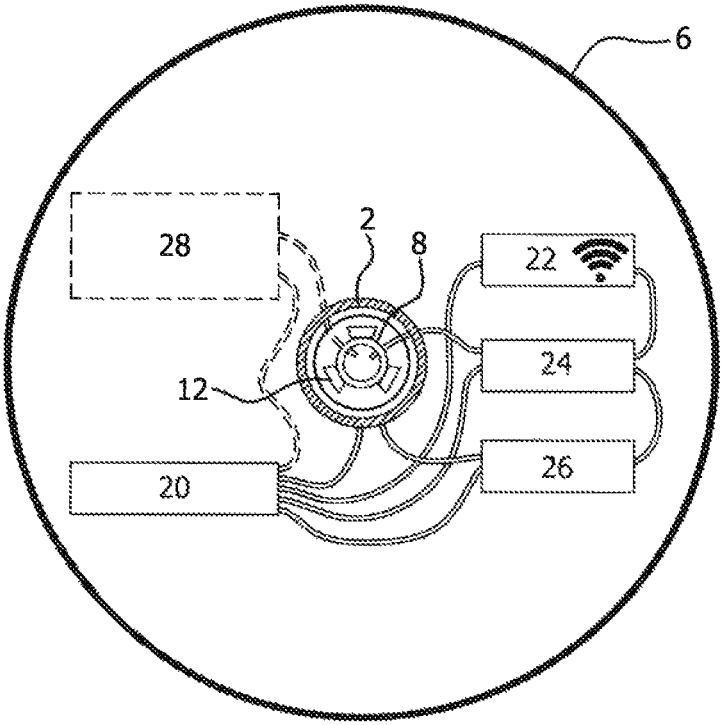
FIG. 4 is a top sectional view of the base of the light stand of the present invention showing the locations of its power supply and electronic components.
Figure 5:
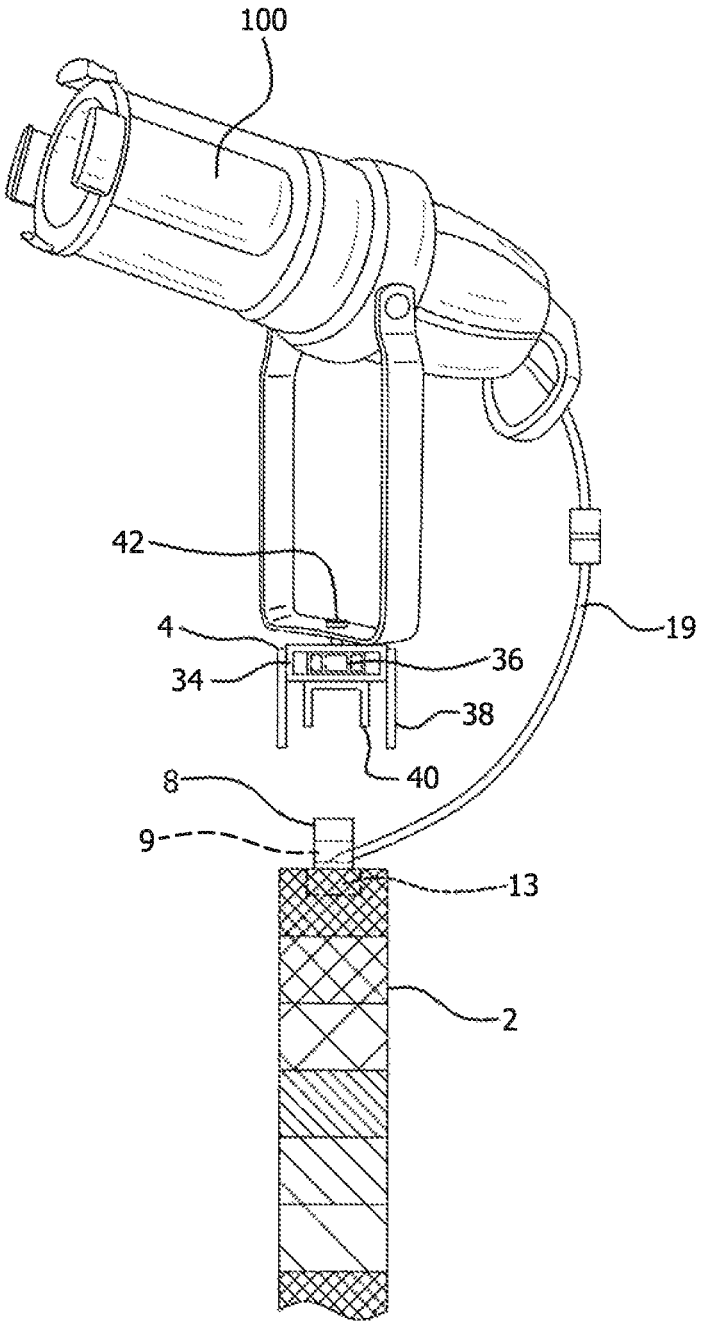
FIG. 5 is a view of the upper section of the light stand of the present invention showing its head mount connection to a lighting fixture.
Figure 6:
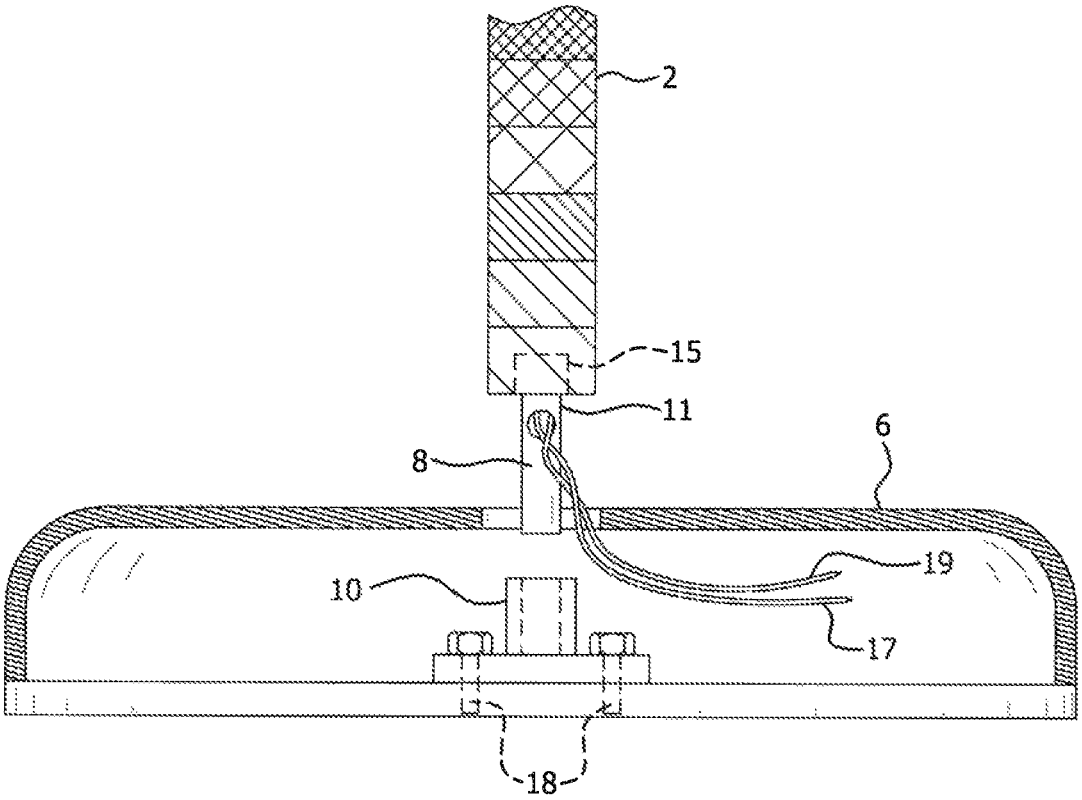
FIG. 6 is a view of the lower section of the light stand of the present invention showing the connection to its base.
Figure 7:
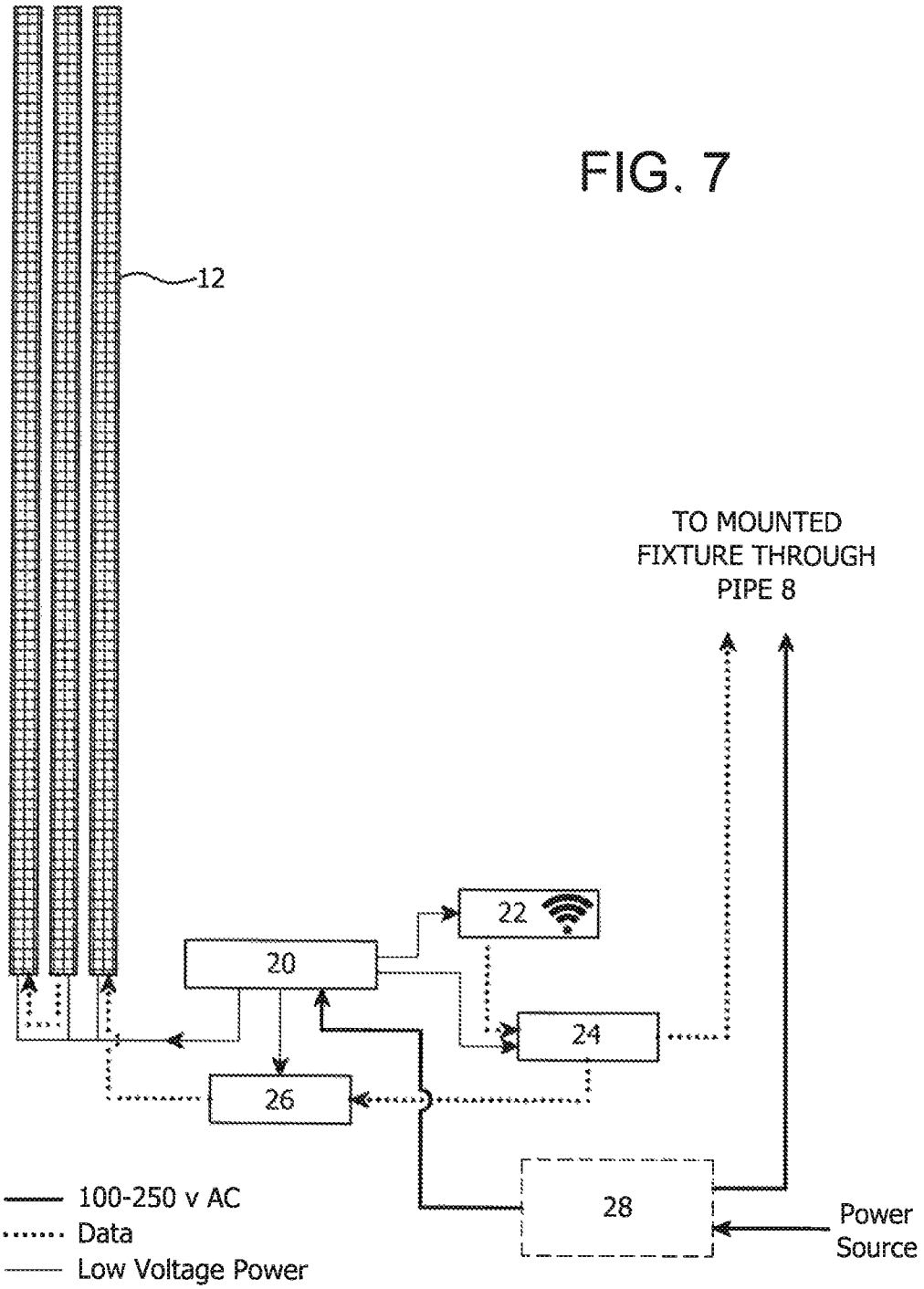
FIG. 7 is a schematic illustrating the connections of the power supply and electronic components and the RGB tape of the light stand of the present invention.

With specific reference to FIG. 3, RGB programmable tape 12 surrounds pipe 8 and extends substantially the length of the pipe. The various different lined and cross-hatched patterns seen in the FIGs., denote different colors and color variations. Diffusing material 14, which could be clear or diffused beads, glass or plastic shards, or equivalent material, circumscribes RGB tape 12 and also extends the length of support pipe 8. Transparent outer tube 16 completely covers diffusing material 14 and extends the length of support pipe 8 as well. Distal ends of illuminated pole 2 are closed off by pole end containment caps 13 and 15.

Illumination pole 2 is attached to light stand base 6 by the insertion of connection pipe 8 to pipe collar 10, Which is secured to the base by bolts 18. Base 6 houses the components required to operate light stand 1. This includes low voltage power supply 20, Wi-Fi receiver/DMX output 22 (a cat-5 cable could provide controlling data as well), DMX opto-spitter 24, DMX decoder/LED driver 26, and optional rechargeable battery 28, As best seen in FIGS. 4-7, data and electrical power cables 17 and 19 extend from these base housed components through lower cable access hole 11 to both RGB tape 12 and out through upper access cable hole 9 to lighting fixture 100.

Illumination pole 2 is attached to head mount 4 which comprises receiver plate 34, receiver nut 36, valence 38, and pipe collar 40. Lighting fixture 100 is connected to head mount 4 by screw 42.

Thus, the components of light stand 1 provide it with the versatility to produce unlimited color combinations and presentations of pixelated color, emanating from both illumination pole 2 and lighting fixture 100. Of course, light stand 1 also serves the basic utilitarian function of supporting a lighting fixture used for basic lighting of environs. It is quite portable and simple to set-up and take-down.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A light stand for supporting a lighting fixture, said light stand comprising:

a lighting fixture head mount;

a bottom base;

an elongated, upright illumination pole extending between the head mount and the bottom base, said illumination pole comprising:

an elongated upright skeletal support pipe, the length of the pipe extending between the head mount and the bottom base, RGB tape surrounding the support pipe and extending the length of the support pipe, and diffusing material circumscribing the RGB tape and extending between the head mount and the bottom base, and a transparent outer tube covering the diffusing material and extending between the head mount and the bottom base; and an electrical power supply located in the base.

2. The light stand as in claim 1, wherein the diffuser material is clear or diffused beads.

3. The light stand as in claim 1 wherein the diffuser material is glass shards.

4. The light stand as in claim 1 wherein the bottom base houses electrical and electronic components which control illumination capabilities of the RGB tape.

5. The light stand as in claim 4 wherein the components comprise a power source, a Wi-Fi receiver, an opto-spitter, and a decoder/LED driver.

6. The light stand as in claim 1, wherein the pipe has upper and lower openings to allow electrical and electronics wiring to extend out from the pipe to the base and the head mount.

* * * * *